United States Patent [19]

Baker

[11] 3,963,007

[45] June 15, 1976

[54] HYDRAULIC VALVE LIFTER OR ADJUSTER

[76] Inventor: Weldon S. Baker, P.O. Box 106, Fort Worth, Tex. 76109

[22] Filed: Mar. 7, 1975

[21] Appl. No.: 556,097

[52] U.S. Cl. ..... 123/90.16; 123/90.61; 123/90.63

[51] Int. Cl.[2] ..... F01L 1/34

[58] Field of Search..... 123/90.61, 90.62, 90.63, 123/90.1, 90.12, 90.15, 90.16, 90.2, 90.48

[56] References Cited

UNITED STATES PATENTS

| | | | |
|---|---|---|---|
| 2,308,858 | 1/1943 | Burkhardt | 123/90.63 |
| 2,739,580 | 3/1956 | Brown | 123/90.63 |
| 3,091,227 | 5/1963 | Neil | 123/90.63 |
| 3,109,418 | 11/1963 | Exline | 123/90.63 |

*Primary Examiner*—Charles J. Myhre
*Assistant Examiner*—Daniel J. O'Connor

[57] ABSTRACT

A hydraulic lifter assembly for adjusting the opening movement of engine valves by push rods actuated by the engine cam shaft is completely self-contained as a unit which may be quickly installed or replaced when necessary. The valve lifter assembly is totally enclosed, so that oil is sealed in the housing and dirt is excluded from the housing reservoir. A plastic indicator cap cooperates with grooves on the exterior of the housing to visually indicate proper valve lifter adjustment and adequate stroke in the operation of the same. The indicator means also makes it apparent when the lifter or adjuster requires attention.

15 Claims, 4 Drawing Figures

FIG.1
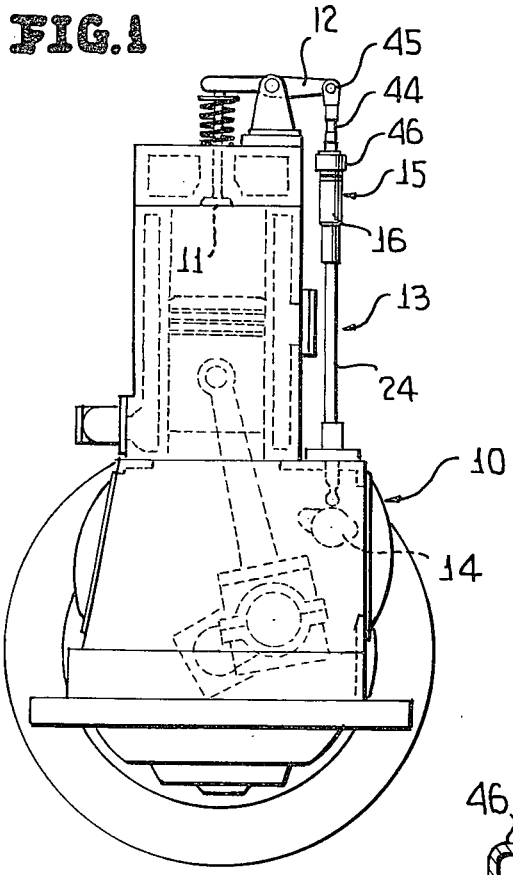
FIG.2
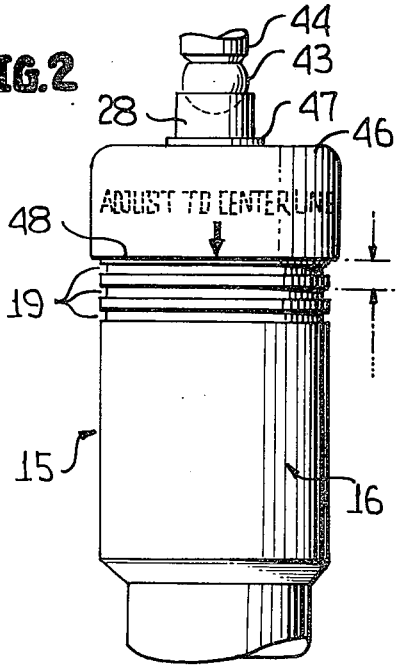
FIG.3
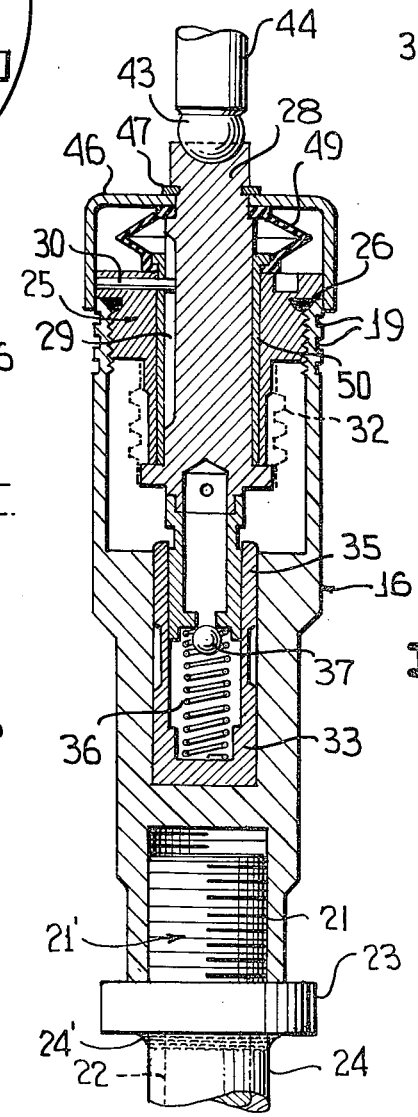
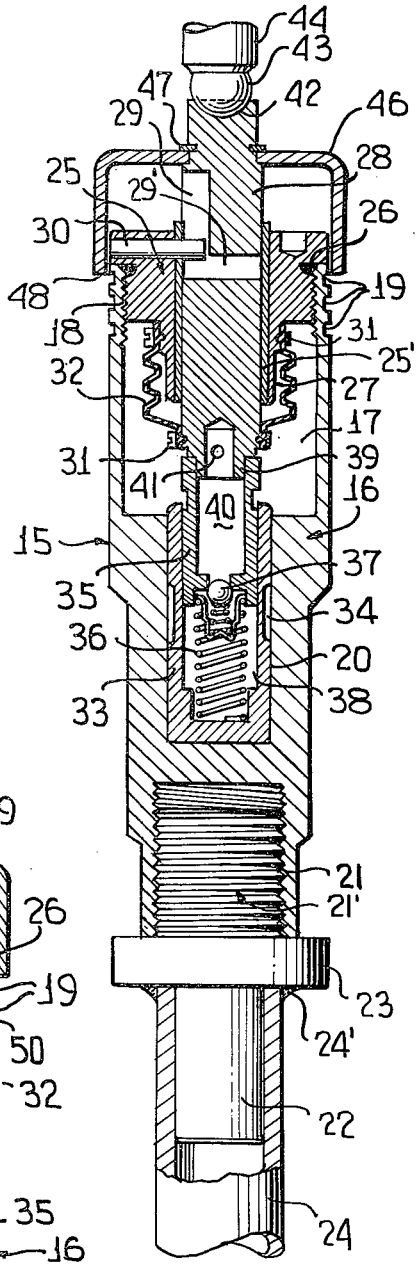
FIG.4

HYDRAULIC VALVE LIFTER OR ADJUSTER

BACKGROUND OF THE INVENTION

Hydraulic valve adjusters or lifters used in engine cam shaft operated push rod assemblies are known in the prior art, and an example of the patented prior art is shown in U.S. Pat. No. 3,109,418 to W. C. Exline et al. Generally, in the prior art as typified by this patent, the hydraulic valve lifters are not totally enclosed or sealed and hence there is the possibility for leakage and for the entry of outside dirt into the hydraulic system. In the prior art, valve lifters, oil or fluid, may sometimes be pumped out of the unit through vent passages leading to the atmosphere and this gradually diminishes the effectiveness of the device during operation.

It is therefore the objective of this invention to improve upon the prior art and alleviate the above-recognized problems incident thereto. This is accomplished in the invention by the provision of a completely enclosed lifter assembly in which no external lubrication is required and no dirt or contaminants may enter the unit to reduce its effectiveness. The invention is entirely compatible with various engine push rod assemblies through a variety of mechanical fittings or coupling parts which are readily available.

Other features and advantages of the invention will become apparent during the course of the following description.

BRIEF DESCRIPTION OF DRAWING FIGURES

FIG. 1 is a simplified end elevational view of valve-in-head engine equipped with the improved valve adjuster or lifter means embodying the invention.

FIG. 2 is an enlarged fragmentary side elevation of the valve lifter unit showing particularly the adjustment indicator means thereof.

FIG. 3 is a central vertical longitudinal section through the invention according to a preferred embodiment thereof.

FIG. 4 is a similar view showing a modification.

DETAILED DESCRIPTION

Referring to the drawings in detail, wherein like numerals designate like parts, and referring first to FIG. 1 wherein an internal combustion engine 10, such as a stationary engine, has an overhead valve 11 whose stem is engaged by a conventional rocker arm 12 for opening the valve in response to longitudinal movement of a push rod assembly 13 actuated by an engine cam shaft 14. The valve lifter assembly forming the subject matter of this invention is shown connected in the push rod assembly at 15 in FIG. 1.

Referring particularly to FIGS. 2 and 3, the hydraulic valve lifter assembly 15 or valve adjuster comprises a body or housing 16 having an upper oil reservoir chamber 17, the bore of which is internally threaded at 18 adjacent the upper open end of the chamber. Externally, the upper end portion of housing 16 has preferably three equally spaced visual indicator grooves 19 whose function in the invention will be described. Below the reservoir chamber 17, housing 16 has a concentric reduced diameter bore or chamber 20, closed at its lower end and opening at its top into the reservoir chamber 17.

At its lower end, the housing 16 has a threaded socket opening 21 to receive a threaded adapter 21' having an abutment flange 23 and a depending cylindrical extension 22. The extension 22 may vary in diameter to enter the bore of a tubular push rod 24 whose size will vary from engine-to-engine. The push rod 24, after being cut to proper length for a particular installation, will then be spot welded at 24' to the flange 23. In this manner, the same body or housing 16 may be made in one size for various engines having push rods 24 of differing lengths and diameters. Only the size of the adapter extension 22 needs to be varied to accommodate various push rod sizes. The push rod assembly 13, FIG. 1, including valve lifter assembly 15, operates in a conventional manner responsive to rotation of the engine crank shaft.

A guide-stop cap 25 has screw-threaded engagement within the upper screw threads 18 of housing 16, and a tightly compressed O-ring seal 26 is intervened, as shown, to seal the reservoir chamber 17 from the escape of fluid or the entry of outside dirt. The cap 25 includes a depending reduced diameter sleeve extension 27 as shown in FIG. 3.

Slidably engaged within the bore of cap 25, which bore is preferably defined by an intervening bushing 25' of any well known dry lube material, is a driver 28. This driver which is cylindrical throughout has a side longitudinal slot 29 near its upper end communicating with a transverse through opening 29' at the bottom of the slot. A transverse pin 30, having a press fit in a radial opening of the cap 25, projects into the slot 29 and effectively prevents rotation of the driver 28 while limiting its axial or longitudinal movement in two directions, with respect to the body 16. The transverse opening 29' is employed for driving the pin 30 out of the cap 25 with a suitable implement when required to disassemble the parts.

A flexible bellows 32 of any suitable rubber-like material is tightly held in surrounding sealing engagement with the cap extension 27 and the lower portion of driver 28 by a pair of preferably plastic self-locking clamp rings 31. These clamp rings are of a type having a catch at one end, through which the other end of a belt-like element is passed and latched or buckled, to provide a tight fitting ring around the two end portions of the bellows. It may also be mentioned here that the described dry lube bushing 25' is held in place or located by the pin 30. The action of the pin 30 in preventing relative rotation between the elements 25 and 28 prevents twisting of the bellows 32. The flexible bellows, formed of oil-resistant material, allows the necessary degree of axial movement of the driver 28 in two directions, up to about one-fourth of an inch, while at all times preventing entry of dirt into the body of the lifter or into the oil reservoir 17 from the top of the assembly.

The valve lifter or adjuster proper is basically of the type commonly employed on automobile engines and readily available on the market for replacement and comprises a lifter body 33, or sleeve, engaged in the bore 20 and having a relief land 34 on its exterior to facilitate entry of the body into the bore in bottomed relationship therewith, as shown. A lifter plunger 35 engages slidably and telescopically in the bore of body 33 and is urged upwardly constantly by a compression spring 36 in the body 33 below plunger 35. An upwardly seating spring-urged ball check valve 37 is provided in the valve lifter assembly, and this one-way valve opens to permit the passage of oil into the bore or chamber 38 of lifter body 33 when the spring 36 displaces the plunger 35 upwardly during operation of the engine. Oil trapped in the chamber 38 can gradually pass around the plunger 35 and re-enter reservoir chamber 17 due to a slight clearance between the plunger and lifter body 33. The reservoir chamber 17 is maintained filled with suitable oil or hydraulic fluid.

At its lower end, driver 28 has a short integral nipple 39 which enters the bore 40 of plunger 35, and a transverse port 41 formed through the nipple 39 allows oil to enter and leave the bore 40 of plunger 35 and to enter the chamber 38 of the lifter body whenever the check valve 37 opens. Upward movement of the driver 28 by plunger 35 under influence of spring 36 is positively limited by contact of pin 30 with the bottom of slot 29. In effect, the only primary moving parts of the assembly are the driver 28 and lifter plunger 35 which slide relative to the fixed cap 25 and lifter body 33. In this connection, the driver 28 may be polished and plated for long wear.

A concave seat 42 in the upper end of driver 28 receives a ball end 43 of upper push rod section 44 which operatively connects to rocker arm 12 as at 45, FIG. 1. A preferably plastic cover and indicator cap 46 telescopes over the top of cap 25 and body 16 and is held seated on a shoulder of driver 28 by a snap ring 47, or equivalent means. The lower edge 48 of the plastic cap skirt coacts with indicator grooves 19 to provide a visual indication at all times of the state of adjustment of the valve lifter. Additionally, the cap 46 prevents the entry of outside dirt into the body of the assembly.

In setting the adjustment of the valve lifter, the driver 28 is moved downwardly by conventional adjusting nuts provided in the push rod assembly 13 until the lower edge 48 of the indicator cap is aligned with the middle groove 19 of the group of three grooves. Any deviation from this position will indicate to an observer that the assembly needs adjustment in order to provide the proper stroke to the engine valve opening mechanism. The skirt of the cap 46 preferably does not contact the outside of cap 25 or body 16 and preferably is slightly spaced from these elements.

The assembly is self-lubricating by means of the body of oil held and sealed within the device.

The mechanical operation of the valve lifter or adjuster is essentially as described in the aforementioned patent 3,109,418 and therefore need not be repeated herein. In comparison to the patented device, however, and the known prior art in general, the invention has a number of advantages in addition to those already described. Very important among these advantages is the fact that in the invention all of the working parts are easily replaceable inexpensively since the lifter components are commercially available items. In the patented device, by contrast, the entire body of the mechanism, the plunger and associated parts must all be replaced and this is quite expensive. It is believed that the advantages of the invention over the prior art will be apparent to those skilled in the art.

FIG. 4 shows a slight modification of the invention wherein an external rubber or rubber-like bellows 49 is mounted between an intermediate bushing 50 on the exterior of the driver 28 and the plastic indicator cap 46. The bellows is held by an upper flange on the bushing 50 and by the snap ring 47 as shown in FIG. 4 so that it may flex as the driver moves axially without being dislodged. The external bellows 49 serves to exclude dirt from entering the assembly and also serves to seal the oil inside of the body 16. As suggested in phantom lines in FIG. 4, both the interior bellows 32, previously described, and the exterior bellows 49 may be employed together in the assembly in some cases for added security. The remaining structure shown in FIG. 4 is identical to that shown in FIG. 2 and need not be redescribed.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. In a hydraulic valve lifter for engines and the like, a housing having a fluid reservoir chamber and a bore leading from said chamber, a cap element secured fixedly to the housing and projecting into said chamber and having a bore, a fluid sealing element interposed between the cap element and said chamber, a driver extending through the bore of the cap element and adapted to slide axially therein, a fluid sealing flexible bellows having opposite ends secured to the cap element and a lower end portion of the driver and allowing essential axial relative movement between the driver and cap element, valve lifter means disposed within the bore of the housing which leads from said chamber and including a spring-urged plunger engaged with a lower end portion of the driver, visual indicator means on the upper end portion of the housing, and cooperating indicator means carried by the driver exteriorly of the housing, said housing and driver adapted for connection with push rod elements of engine valve opening mechanism.

2. The structure of claim 1, and said driver having a longitudinal keyway, and a key element fixed to said cap element and projecting into said keyway slidably, whereby the driver is prevented from rotating on its axis and twisting said bellows.

3. The structure of claim 2, and an additional external flexible bellows sealingly engaged with said driver exteriorly of the housing and cap element and also sealingly engaged with said cap element and allowing relative axial movement between the driver and cap element.

4. The structure of claim 1, and said visual indicator means on said housing comprising plural grooves in the exterior of the housing, and said cooperating indicator means comprising a dirt excluding cap on the driver having a marginal skirt engaging telescopically over the housing in the region of said grooves, said skirt having an end constituting an indicator element observable in relation to said grooves.

5. The structure of claim 1, and said driver having first and second longitudinally spaced stop means thereon, and a stop element secured to the cap element and extending into the path of movement of said first and second stop means of the driver to positively limit longitudinal movement of the driver in two directions.

6. The structure of claim 5, and said first and second stop means of the driver comprising the end walls of a slot formed in one side of the driver longitudinally, and said stop element secured to the cap element consisting of a pin anchored radially to the cap element and having an interior end portion projecting into said slot in the path of movement of said slot end walls, said pin preventing rotation of the driver by engagement with the slot side walls.

7. The structure of claim 1, and clamping ring means securing the opposite ends of said bellows to said cap element and driver sealingly with the bellows completely surrounding the adjacent portions of the cap element and driver.

8. The structure of claim 1, and said housing having a lower end socket opening below said bore, an adapter having one end portion releasably secured in said socket opening, and a second end portion on the adapter sized to enter the bore of a tubular push rod section, the push rod section secured to the adapter.

9. The structure of claim 8, and said socket opening of said housing being screw-threaded, said one end portion of the adapter being screw-threaded for engagement in the socket opening, said second end portion of the adapter being cylindrical and adapted to be sized variably for fitment into bores of variously sized tubular push rod sections.

10. The structure of claim 9, and an enlarged flange on the adapter separating said first and second end portions and having a face adapted to abut the adjacent end of the housing and having a second face adapted to abut one end of the push rod element, said flange also adapted to be welded to the push rod element.

11. The structure of claim 1, and one end of the driver projecting outwardly of the cap element and indicator means having a concave recess to receive a ball end of a push rod section.

12. The structure of claim 1, and said cap element being screw-threaded into said housing, and said fluid sealing element comprising an O-ring seal interposed between the cap element and housing.

13. The structure of claim 6, and said driver having a transverse opening formed therethrough and communicating with the lower end of said slot and adapted to receive an implement for the purpose of dislodging said pin from the cap element, said pin being tightly pressed into a radial opening of the cap element.

14. The structure of claim 13, and a bushing interposed between the driver and the bore of the cap element and having a radial opening adjacent to said slot receiving said pin in order to locate the bushing.

15. The structure of claim 14, and said bushing being a thin dry lube bushing.

* * * * *